US007355153B1

(12) United States Patent
Nuzzolillo

(10) Patent No.: US 7,355,153 B1
(45) Date of Patent: Apr. 8, 2008

(54) MICROWAVE OVEN LINERS

(76) Inventor: Pasquale J. Nuzzolillo, 7 Mansfield Rd., North Heaven, CT (US) 06473

( * ) Notice: Subject to any disclaimer, the term of this patent is extended or adjusted under 35 U.S.C. 154(b) by 0 days.

(21) Appl. No.: 11/656,292

(22) Filed: Jan. 22, 2007

(51) Int. Cl.
*H05B 6/80* (2006.01)

(52) U.S. Cl. ..... 219/725; 219/729; 219/754; 219/756; 99/DIG. 14

(58) Field of Classification Search ..... 219/725–735, 219/756, 757, 762, 754; 99/DIG. 14
See application file for complete search history.

(56) References Cited

U.S. PATENT DOCUMENTS

| | | | | |
|---|---|---|---|---|
| 3,368,732 | A | | 2/1968 | Kimble |
| 4,633,052 | A | | 12/1986 | Beavers et al. |
| 4,778,968 | A | | 10/1988 | Torres |
| 5,290,985 | A | * | 3/1994 | Jancic et al. ..... 219/725 |
| 6,137,097 | A | | 10/2000 | Smith et al. |

* cited by examiner

*Primary Examiner*—Tu Ba Hoang
*Assistant Examiner*—Leonid Fastovsky

(57) ABSTRACT

A liner unit for a microwave oven. The liner unit has a plurality of disposable liners in a stack and which are adhered to each other to be peeled off each other. Each liner is disposable and will protect the interior surfaces of the oven against splatters and spills. After use, the liner is simply peeled off the stack of liners and discarded. Each of the liners has openings associated with a microwave oven.

2 Claims, 1 Drawing Sheet

MICROWAVE OVEN LINERS

TECHNICAL FIELD OF THE INVENTION

The present invention relates to the general art of cooking utensils, and to the particular field of microwave ovens.

BACKGROUND OF THE INVENTION

In the use of microwave ovens, which are installed in homes, restaurants and other commercial establishments, it is not uncommon for the food items being heated or cooked to overflow slightly or splatter within the microwave oven chamber. Usually, the oven chamber is defined by walls of a plastics material or metal such as stainless steel, and has smooth inner surfaces to facilitate cleaning of the wall surfaces after the oven has been used for some period of time. The cleaning operation is usually performed manually with a sponge and a detergent solution and must be performed frequently if the microwave oven receives extensive use, for example, in a commercial kitchen or in association with food vending machines. In such uses and in some home uses, considerable time and effort are required to maintain the microwave oven chamber in a clean and sanitary condition.

Therefore, there is a need for a means for protecting the inner surfaces of a microwave oven in a manner that makes clean up efficient and expeditious.

SUMMARY OF THE INVENTION

The above-discussed disadvantages of the prior art are overcome by a liner unit for a microwave oven. The liner unit has a plurality of disposable liners in a stack and which are adhered to each other to be peeled off each other. Each liner is disposable and will protect the interior surfaces of the oven against splatters and spills. After use, the liner is simply peeled off the stack of liners and discarded. Each of the liners has openings associated with a microwave oven.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figures 1, 2, 3:
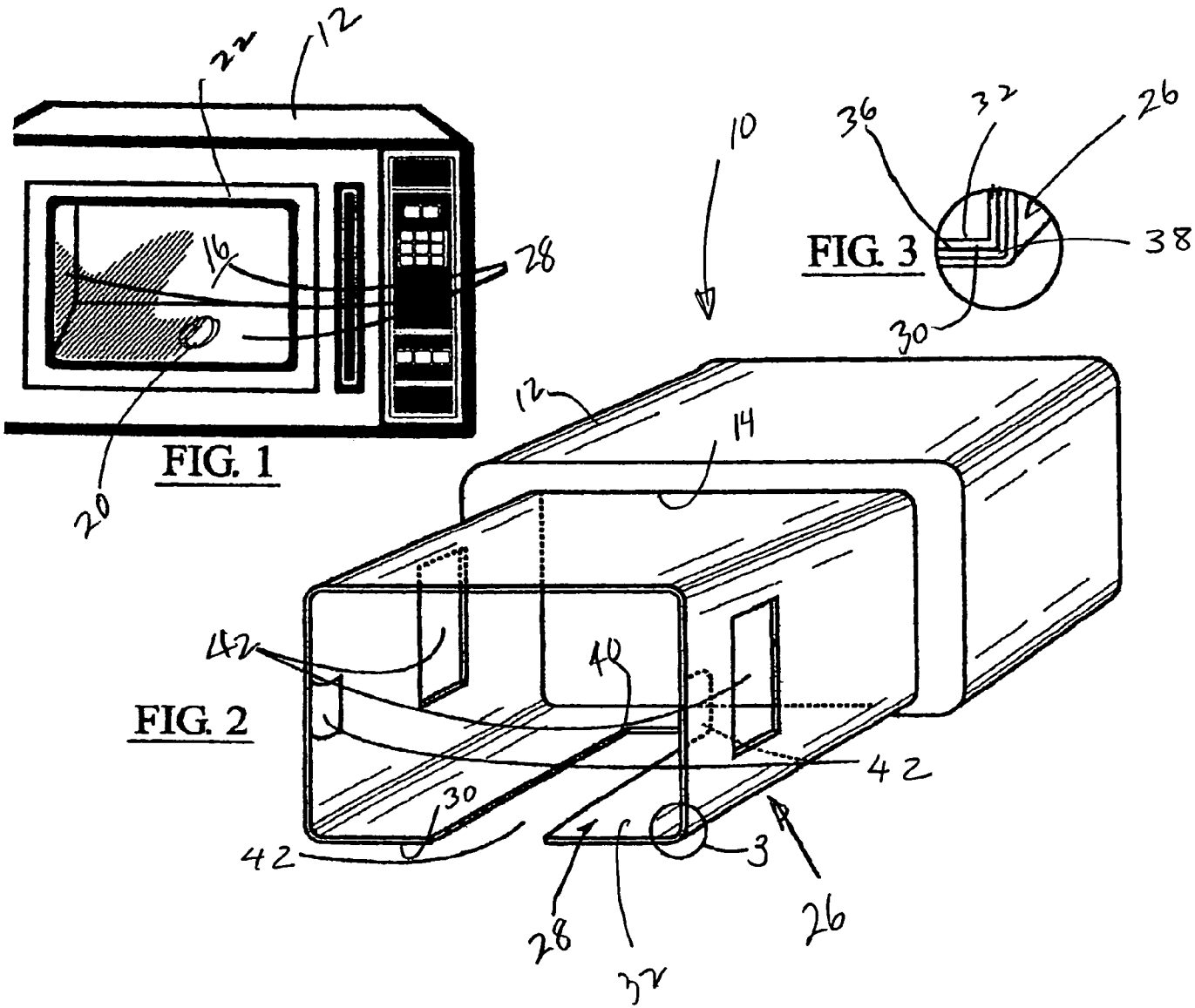
FIG. 1 is a perspective view of a microwave oven having therein the liner unit embodying the present invention.
FIG. 2 shows the liner unit of the present invention partially inserted into a microwave oven.
FIG. 3 shows a detail of FIG. 2 and shows the stack of liners of the present invention.

Referring to the figures, it can be understood that the present invention is embodied in a microwave liner unit 10. Unit 10 comprises a microwave oven 12 which has an interior surface 14 and an interior volume 16 defined by the interior surface and in which food is cooked. A carousel table 20 and a door 22 for covering the interior volume are also mounted on the oven.

A liner unit 26 is used to maintain the interior surface of the microwave oven clean. Liner unit 26 includes a plurality of disposable liners, such as liner 28. The liners are identical to each other and each liner includes a first surface 30 which is an outer surface when the liner is in use, with the use orientation being shown in FIG. 3, a second surface 32 which is an inner surface when the liner is in use. Second surface 32 is located adjacent to the interior volume when the liner is in use.

Each liner further includes a layer 36 of adhesive on the first surface. The layer of adhesive on each liner is located to releasably adhere to the second surface of an adjacent liner 38. Each liner further includes a cutout 40 which accommodates the carousel when the liner is in use. Other cutouts 42 accommodate other elements of the microwave oven, such as fans, lights and the like.

Each liner is sized to cover the interior surface of the microwave oven when in use, and each liner is adapted to be releasably held in place on an adjacent liner when in use and to be released from an interior surface covering position by removing the liner from its releasably held position. In this manner, a package of liners can be placed in a microwave oven and each liner removed after use. This maintains the interior surfaces of the oven clean.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A microwave liner unit comprising:

A) a microwave oven having an interior surface, an interior volume defined by the interior surface and in which food is cooked, a carousel table, and a door covering the interior volume; and B) a liner unit which includes a plurality of disposable liners, each liner including (1) a first surface which is an outer surface when the liner is in use, (2) a second surface which is an inner surface when the liner is in use, and which is located adjacent to the interior volume when the liner is in use, (3) a layer of adhesive on the first surface of each liner, the layer of adhesive being located to releasably adhere to the second surface of an adjacent liner, (4) a cutout which accommodates the carousel when the liner is in use, (5) each liner being sized to cover the interior surface of the microwave oven when in use, and (6) each liner being adapted to be releasably held in place on an adjacent liner when in use and to be released from an interior surface covering position by removing the liner from its releasably held position.

2. A method of protecting a microwave oven comprising

A) providing a liner unit with a plurality of liners and releasably holding each liner to an adjacent liner;

B) peeling each liner away from the adjacent liner after use; and

C) disposing of a liner after it has been peeled away from the adjacent liner.

* * * * *